United States Patent [19]

Schwartz

[11] 4,010,988

[45] Mar. 8, 1977

[54] TOWEL APPARATUS

[76] Inventor: James W. Schwartz, 782 Shag Bark Lane, Deerfield, Ill. 60015

[22] Filed: Mar. 7, 1975

[21] Appl. No.: 556,104

Related U.S. Application Data

[63] Continuation of Ser. No. 755,013, Aug. 23, 1968, Pat. No. 3,884,630.

[52] U.S. Cl. ..... 312/38; 8/142

[51] Int. Cl.[2] ..... B65H 19/00; D06I 1/00

[58] Field of Search ..... 312/38, 39; 428/224, 428/237, 240, 244, 395; 8/142, 158; 242/55.3, 55.53

[56] References Cited

UNITED STATES PATENTS

| | | | |
|---|---|---|---|
| 3,222,112 | 12/1965 | Bahnsen | 312/38 |
| 3,535,141 | 10/1970 | Marco | 428/224 |
| 3,682,756 | 3/1970 | Kalwaites | 428/224 |
| 3,826,548 | 7/1974 | Schnyder | 312/38 |
| 3,858,951 | 1/1975 | Rasmussen | 312/38 |
| 3,858,952 | 1/1975 | Bahnsen | 312/38 |
| 3,884,630 | 5/1975 | Schwartz | 8/158 |

*Primary Examiner*—Casmir A. Nunberg
*Attorney, Agent, or Firm*—Tilton, Fallon, Lungmus, Chestnut & Hill

[57] ABSTRACT

A towel apparatus which handles an endless towel within a cabinet and subjects the same to cleaning and drawing, making use of a low vapor pressure chemical type solvent.

7 Claims, 9 Drawing Figures

FIG. 3
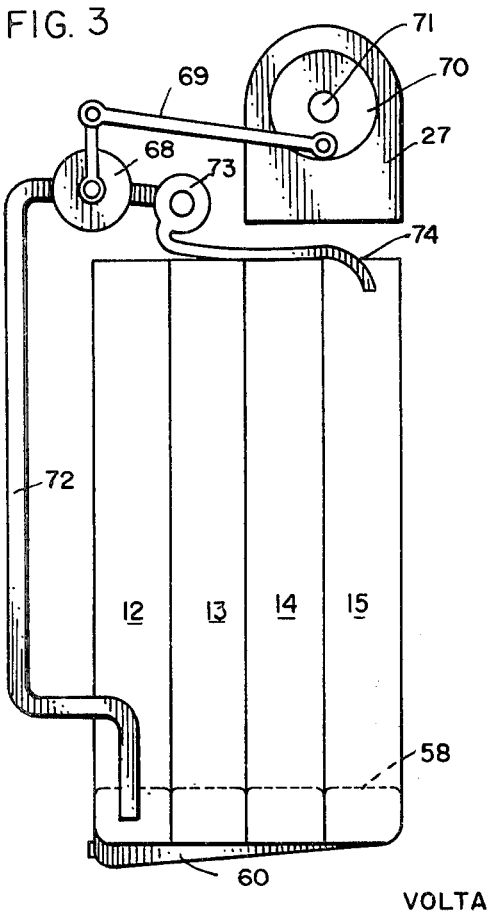
FIG. 4
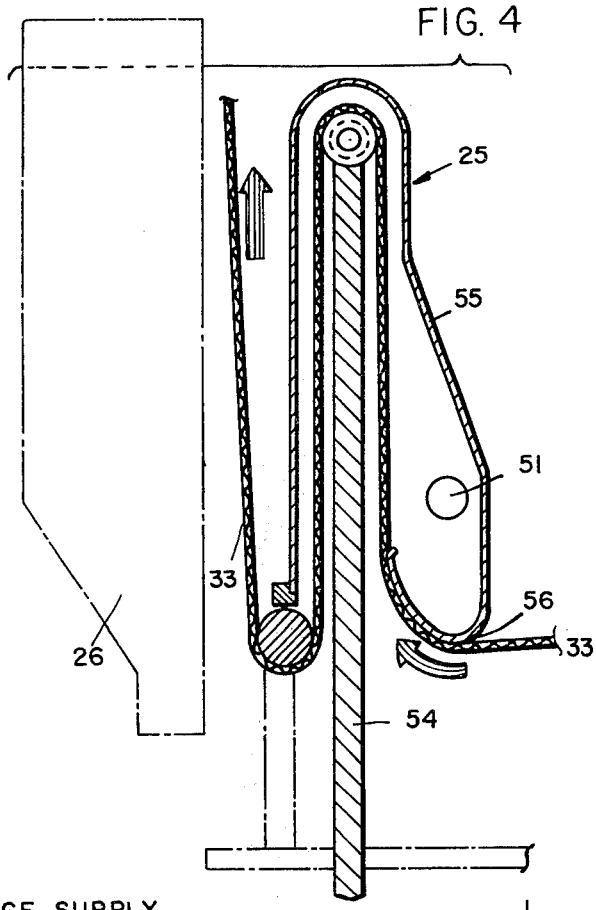
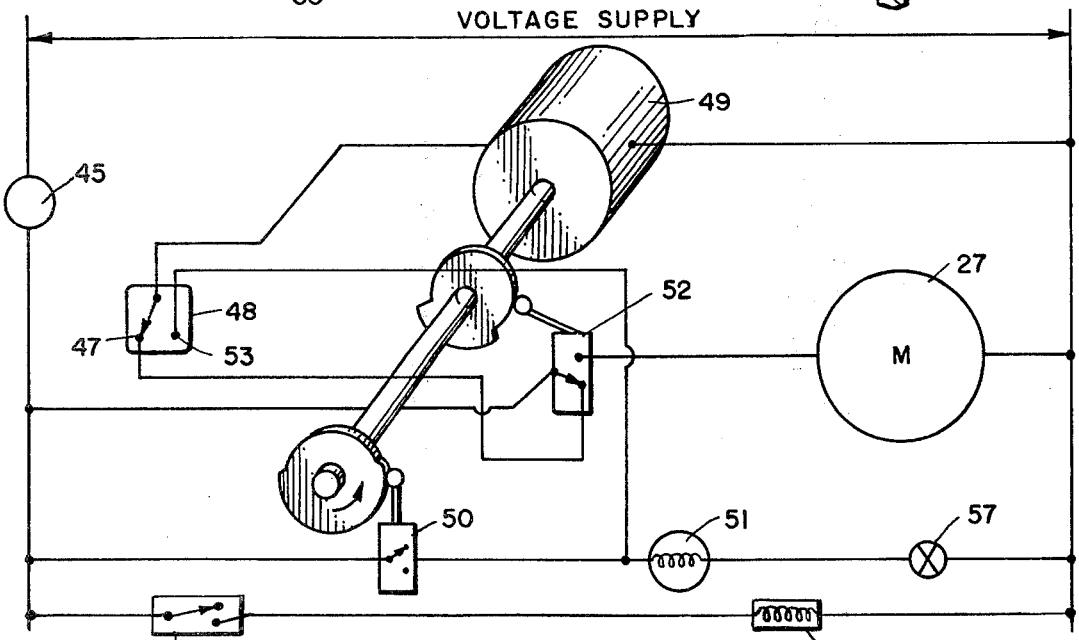
FIG. 5

TOWEL APPARATUS

This application is a continuation of my application Ser. No. 755,013, filed Aug. 23, 1968, and now U.S. Pat. No. 3,884,630.

BACKGROUND AND SUMMARY OF THE INVENTION

My towel cleaning, drying, and dispensing machine for use in washrooms is a novel apparatus which successfully enables freshly cleaned roll fabric toweling to be continuously available as needed by persons using the washroom. Currently available roll towel machines are inconvenient and uneconomical because they require frequent replacement of the soiled towel with a fresh roll. This usually entails a requirement for storage of clean and used towel rolls and periodic transportation of toweling to and from a central laundry facility. In practice, the end of the roll is often arrived at long before replacement is initiated. This unsatisfactory condition has sometimes led to the installation of additional machines in order to enhance the chances that at least one machine will contain clean toweling. Despite these limitations, roll fabric towel machines enjoy widespread use. This is because the user finds fabric towels more comfortable and obtains faster and more complete drying of the skin than with competing means such as paper towels or hot air blowers Several patents have been granted in recent years for dispensing and automatically laundering roll towels, but the devices of these patents have not found general application because of numerous practical problems. Among these is the expense associated with required water and drain connections, difficulty in obtaining a clean appearance in laundered towels, rapid deterioration of towels, wide variation in the exposed length of clean toweling, and very large and critical power requirements for drying cleaned toweling.

The primary object of this invention therefore is to provide a novel and practical apparatus for automatically and continuously providing cleaned and dried roll toweling. More particularly, it is an object of this invention to provide new and improved roll towel apparatus which utilizes self-contained cleaning means without incurring the need for water supply and drain connections.

Another object of this invention is to provide a towel dispensing and cleaning apparatus in which the toweling does not readily attain a stained and unsightly appearance.

Another object is to provide a towel dispensing and cleaning apparatus in which a suitable length of exposed toweling is always present.

Another object is to provide a towel dispensing and cleaning apparatus in which drying of the cleaned toweling is accomplished in a rapid, safe and economical manner.

Another object is to provide a towel dispensing and cleaning apparatus in which requirements for replenishment of the liquid cleaning vehicle is minimized.

Another object is to provide a towel dispensing and cleaning apparatus in which regeneration of the liquid cleaning vehicle is automatically accomplished.

Still another object is to provide a towel dispensing and cleaning apparatus which contains means for disposing of water imparted to the towel during use by employing vapor phase dispersion.

Further objects and advantages of the present invention will be apparent from the following description and accompanying drawings in which:

FIG. 3 depicts details of the cleaning fluid regeneration system;

FIG. 4 is an enlarged fragmentary side view similar to FIG. 1, with certain details of the drying mechanism more clearly shown;

FIG. 5 is an electrical wiring diagram of the towel drive control mechanism, the drying system, and the water evaporation system;

Figure 1:
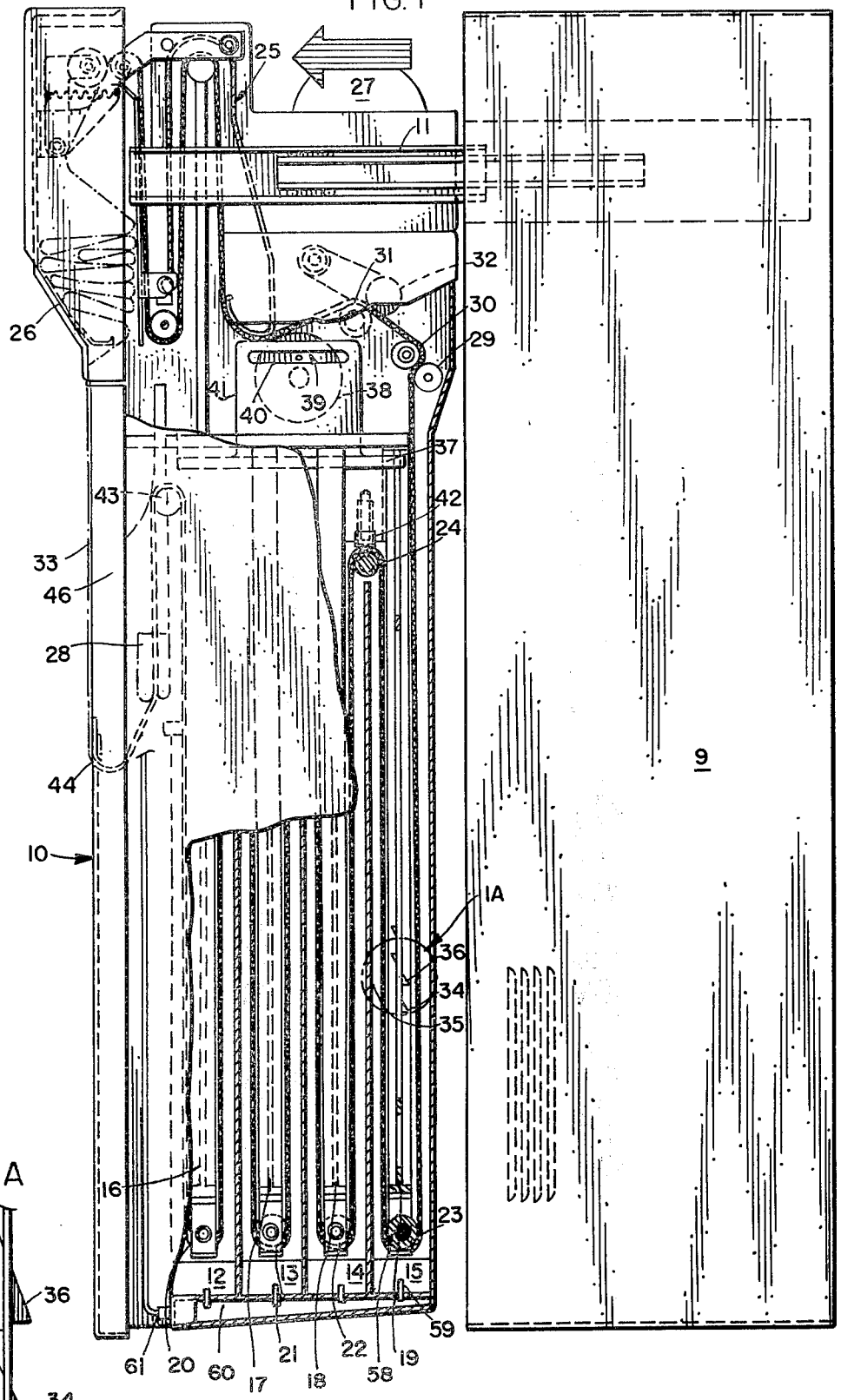
FIG. 1 is a separated vertical side sectional view of a towel dispensing, cleaning, and drying apparatus embodying the teachings of this invention; also FIG. 1A as being an enlargement of the circled portion in FIG. 1 designated 1*a;*
Figure 1A:
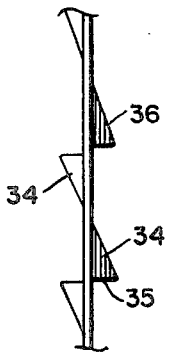
Figure 2:
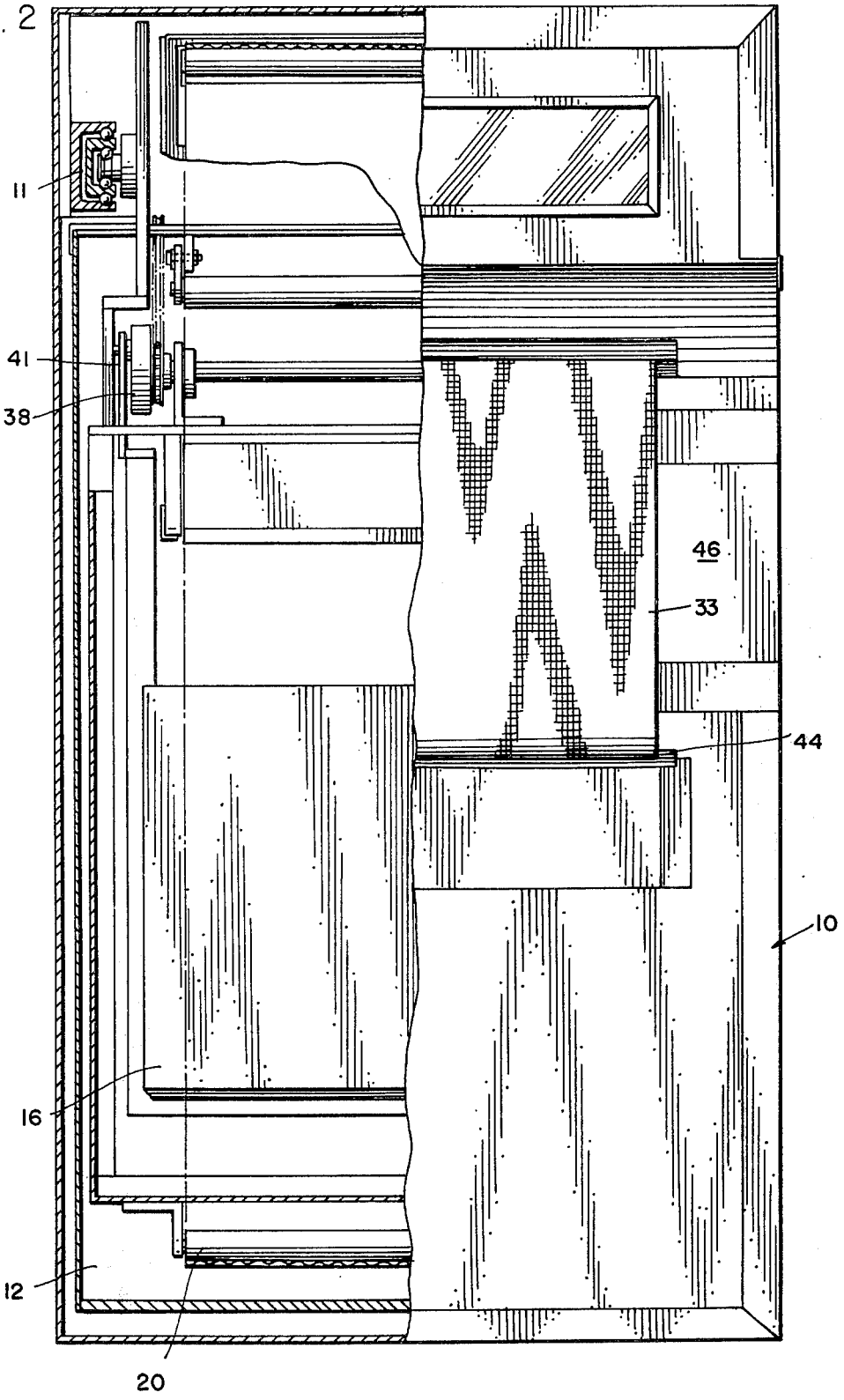
FIG. 2 is a vertical front sectional view of the apparatus.

Referring to FIGS. 1 and 2, there is shown a cabinet-like housing or casing consisting of stationary member 9, which includes top, bottom, side, and rear panel sections, and a movable member generally designated 10 which acts as a front cover for the housing. A slide rail assembly 11 (see the upper part of FIG. 1) operates to support the front panel towel supply and processing mechanism 10 within the confines of stationary housing member 9. When the mechanism requires service, the slide rail assembly 11 is extended to allow the entire mechanism to be withdrawn from within the stationary member 9.

The processing mechanism consists of tank sections 12, 13, 14, and 15 which contain special cleaning fluids; agitation plates 16, 17, 18, and 19 (one for each tank); Iowa towel guide rolls 20, 21, 22, 23, and upper guides as at 24, all of which cooperate to send the toweling through a serpentine or zigzag path. The mechanism also includes a drying unit generally designated 25, a towel storage section 26, drive motor 27, straightening device 28, pairs of wringer rolls 29–32, and additional elements and parts to be described subsequently.

Towel member 33 consists of an endless fabric belt. In prior art applications, belts have been manufactured of white cotton material. This practice incurs a number of serious problems. These include the fact that cotton is to absorbent to properly meet the present requirements, thus rendering the towel very difficult to properly clean with a simple mechanism and too difficult to dry with practical drying apparatus. Additionally, cotton does not exhibit sufficient durability when subjected to repeated cycles of submersion in cleaning fluids, wringer action, and heat accelerated drying. Certain synthetic fabrics such as nylon, on the other hand, do not exhibit sufficient absorbency to allow satisfactory drying of the user's wet skin. Accordingly, a strong, durable fabric of intermediate absorbency is required. Such a fabric must be resistant to the special cleaning fluids and the elevated temperatures encountered in drying. Certain polyester-based fabrics and blends of polyester fibers with other fibers have been found particularly suited to this exacting application.

Towel member 33 is preferably manufactured of a multi-colored fabric embodying an irregularly grained or small pattern appearance rather than from the customary plain or nearly plain white material. White toweling readily reveals slight stains and discolorations which may develop, but which in no way affect the hygienic or drying properties of the towel.

During the cleaning cycle, towel member 33 is progressively drawn through tanks 12, 13, 14, and 15 while being supported alternately by cylindrical guide rolls 20–24 (the other three upper rolls not being shown in FIG. 1). In order to assure thorough cleaning, it is important to subject nearly the entire fluid in the tanks to vigorous agitation. Agitators 16–19 are of especially advantageous design. Not only do they effectively supply the required local agitation, but they also provide a circulatory action to the body of liquid contained in each tank. Each agitator is provided with an array of horizontally extending ribs 34 of assymetrical cross section. The flat portion 35 of the ribs is more effective in pushing the fluid than the tapered section 36. It is this feature of the rib assymetry that imparts mass circulating flow to the fluid when the agitators are in motion. Bracket member 37 connects the individual agitators in such a manner as to simultaneously transmit vertical undulation forces to each of the agitators. Electric motor 27 is coupled to eccentric cam 38 which cooperates with slide coupling 39 and slot 40 in connecting plate 41 to impart the required reciprocating motion to bracket 37. In order to minimize the amount of cleaning fluid carried over from one tank and into the succeeding one by the progressive towel movement during cleaning, squeeze bars, as at 42, relative to the agitating assembly in tank 15 cooperate with the upper cylindrical rollers exemplified by 24 to remove excess liquid from the towel. Cylindrical rolls 29–32 are coupled by a chain to the output shaft of motor 27. These pairs of rolls serve the dual purpose of wringing excess liquid from the cleaned portion of towel member 33, and of imparting sufficient force to pull the towel through the cleaning tanks. Cleaning fluid thus removed from the towel is returned to the tanks by gravitational force.

Cylindrical roll 43 is also driven by power from motor 27 and serves to pull the externally exposed section of towel 33 into the cabinet and through straightening member 28. The towel enters the cabinet through slot 44. An important feature of slot 44 is its narrow opening with no extended taper. This construction insures that the user's fingers or clothing cannot be squeezed or abraded by being.drawn into the slot by the moving towel. For additional protection, slot 44 may be flexibly supported in such a manner that excessive force against it causes an electrical switch 45 (see FIG. 5) in the drive motor circuit to open, thus stopping the towel movement. Prior to use, the portion of the towel external to the cabinet is taut. Recessed areas 46 (shown in FIG. 2) allow the user to conveniently grasp the towel and to pull an additional length from the storage compartment 36 if desired.

Release of tension in the portion of the towel external to the cabinet causes contact 47 of electrical switch 48 (shown in FIG. 5) to close. Closing of contact 47 of switch 48 activates sequence timer motor 49. Activation of motor 49 for a short interval — such as 4 seconds — causes contacts on switch 50 to close, supplying power to heater element 51. After a suitable additional interval — such as 6 seconds — normally open contacts of switch 52 close, connecting the electrical power source to drive motor 27, and causing power to be removed from timer motor 49. Drive motor 27 and heater 51 continue to operate. When sufficient toweling has been pulled into the cabinet, contact 47 of switch 48 will be caused to open and contact 53 of that switch will close. This again restores power to timer motor 49. Subsequent operation of motor 49 for a period of approximately five seconds causes switches 52 and 50 to return to their normal positions, thus removing power from timing motor 49, drive motor 27, and heater 51. The purpose of the last 5-second period in the sequence is to automatically advance a clean section of toweling from the storage section of the cabinet and to insure that all soiled sections are immediately immersed in cleaning fluid. This insures the next user an entirely clean towel section and prevents setting or drying of soiled spots on used portions of the towel.

All prior apparatus of this general type have attempted to maintain a constant length loop of toweling outside of the cabinet. Although this is practical for non-recirculating roll towel apparatus, it is undesirable for apparatus of the present type. This is because even the slightest difference in rate of withdrawal and rate of entry of the toweling will eventually reduce the loop to either a tight section or, alternatively, will produce an exceedingly large external loop. The transport system of the present invention quite obviously avoids any such problem. Heater 51 supplies the necessary heat of vaporization required to dry the cleaned towel section.

Referring to FIG. 4, condensing walls 54 and 55 collect all vapor driven from the heated towel section and provide a path for the return of the cleaning fluid, under gravity, to the cleaning tanks. Portions of condensing wall 55 act as a radiation reflector for energy from heater 51. Condensing wall 54 extends into a cleaning fluid tank. Heat transferred to the condensing wall is conducted to the liquid in the tank and dissipated therein. Heat imparted to condensing wall 55 is used to preheat toweling moistened with cleaning fluid prior to entering drying section 25. The toweling is caused to contact wall 55 at curved portion 56. Curved portion 56 also acts as a catch trough for directing condensed liquid sidewards and downwards into the tanks. Time delays, both prior and subsequent to the period of motor driven towel movement, are provided to insure that no sections of damp toweling will enter section 26. Thermal switch 57 monitors the temperature of the toweling exposed to heater 51, and causes power to be disconnected from said heater when a prescribed upper temperature limit is exceeded.

Previous attempts to successfully perfect a self-contained towel cleaning, drying, and dispensing machine relied upon a continuous supply of water for use in the cleaning and rinsing tanks. Although apparatus employing water as the cleaning medium is surely feasible, it presents several very serious practical difficulties. Not only must suitable supply and drain connections be provided, but means must be provided to properly deal with widely varying conditions of dissolved minerals (hardness) in the water. This problem creates variable conditions of cleaning efficiency, and, more importantly, tends to create mineral residue build-up on the towel and on various internal parts of the apparatus. Prerhaps the most serious of the many problems associated with apparatus seeking to employ water for cleaning is the severe drying power requirements.

In order to meet practical use requirements, apparatus of the type anticipated in the present invention must be capable of processing toweling at a rate of roughly 20 square inches per second. Experiments have shown that it is difficult to extract the last 0.01 cubic inch of water per square inch of towel surface by purely mechanical means such as wringer action. The power required to supply the necessary energy to raise the damp towel section temperature and to evaporate the water is approximately 10 kw. Only special heavy duty wiring circuits are capable of supplying such a large power demand. The problems associated with apparatus employing water as the principal cleaning fluid and rinsing fluid are largely eliminated by the use of a suitably chosen liquid chemical cleaning fluid. The following are desirable characteristics of such a cleaning fluid:

A. Minimal toxicity.
B. Very low vapor pressure and evaporation rate.
C. Moderate specific heat and heat of vaporization.
D. Boiling point substantially greater than 100 c. but not excessively high.
E. Low viscosity.
F. High solvent action for grease, waxes, soaps, etc.
G. Faint or pleasant odor.
H. Low water solubility therein, and minimal solubility in water.
I. Low flammability and high flash point.
J. Density substantially different from water and preferably less than water.
K. Chemically and thermally stable and noncorrosive.
L. Antiseptic properties.
M. Moderate cost.

Conventional fabric cleaning fluids all fail to meet the requirements of the present application. Obviously, the exacting and extensive list of desirable properties greatly restricts the choice of suitable fluids. The following chemical solvents however, adequately meet the combined requirements of the present application:

1. 2-Ethylhexanol
2. Texanol (Eastman Chemical Co.)
3. Benzyl alcohol
4. 2-Phenoxyethanol.

The first two liquids have specific gravities less than 1.0, and the latter two have specific gravities greater than 1.0. Water removed from the towel will collect on the bottom of the tanks if the solvent specific gravity is less than 1.0, and at the top of the solvent surface if the specific gravity is greater than 1.0. Disposal of the water is more readily facilitated when it collects at the bottom of the tanks, and it is prevented from recoating the towel as the towel passes through the liquid surface. 2-Ethylhexanol is the preferred fluid since it has a boiling point of 185 c. and a specific gravity of 0.83, while Texanol has a somewhat higher boiling point and a specific gravity of .95.

Low vapor pressure is, of course, necessary to prevent evaporation and consequent loss of solvent from the apparatus. A slight degree of solubility of water in the solvent is helpful in removing water from the towel. Solubility of the solvent in water, however, is not desirable, since some solvent may be lost in subsequent disposal of the water. The specific heat of 2-Ethylhexanol is 0.56, and its rate of vaporization is 92 cal/g. Accordingly, the ratio of energy required to heat to the boiling point and then evaporate equal volumes of water and solvent is 4.7 to 1. This reduces the drying power requirement to a practical value of about 2 kw. By preheating the towel as it enters the drying section with heat energy recovered by condensation on wall 55, the 2 kw. requirement can be further reduced. Four perforated partitions (as at 58 relative to tank 15) allow water and other insoluble matter to collect in the bottom of each tank. Turbulence of the cleaning fluid, induced by the agitators, does not extend into the region of the tank bottoms because of the perforated partitions. This isolation prevents precipitated material from being remixed with the fluid in the upper portion of the tanks. A number of arrangements can be used to remove collected water from the bottom of the tanks. A particularly simple and effective means is illustrated in FIG. 1 wherein four tubular members (as at 59 relative to tank 15) serve as stand pipe drains for tanks. The fact that the drain tubes extend upward above the tank bottom tends to exclude heavier than water precipitated material from being drawn into the drains. The drains discharge into tapered trough 60. When the collected water level in any tank bottom exceeds the height of the drain tube, the water will automatically drain into the trough. The bottom of the drain tubes are at different heights, progressing upward in the direction of towel propagation. This arrangement allows self-leveling of the liquid in the tanks, and largely prevents the transfer of water from one tank to another one.

Figure 6:
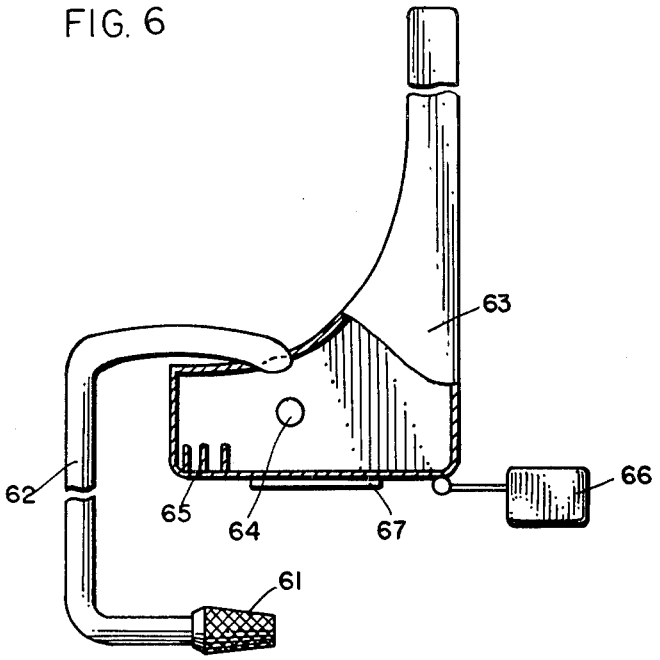
FIG. 6 is a fragmentary sectional view of the water disposal system.

Porous plug 61, once wet with water, will pass water freely, but will reject cleaning solvent should it ever impinge upon its surface. The required selective permeability properties are obtained by proper design of the capillary action of the porous plug. Normally, the water level in the trough is such that the surface of the plug is always immersed in water. A flexible water exhaust tube 62, shown in enlarged scale in FIG. 6, connects to the outlet side of porous plug 61 and extends upward to discharge into evaporator chamber 63. The upper end of exhaust tube 62 is located somewhat below the normal fluid level in the tanks. The best location depends upon the specific gravity of the solvent. For 2-Ethylhexanol the optimum height is about 83% of the normal liquid depth in the tanks. If the tube end is substantially below this height, there will be a tendency to drain so much water from the tanks that cleaning solvent will fill the drain trough. If the tube end is located substantially above the optimum height, an excessive depth of water will accumulate in the bottom of the tanks. In general, for cleaning solvents with specific gravities less than that of water (1.0), the optimum height of the tube above the tank bottom is slightly more than the product of the solvent specific gravity and the normal fluid depth in the tanks. The exact value depends to a minor extent on the capillary rise effect in tube 62 and the desired residual depth of water in the bottom of the tanks. An appropriate height increase due to these considerations is about one-half inch.

As an added precaution, to prevent fluid from spilling out of the apparatus, the height of the outlet opening of evaporation chamber 63 is placed above the normal fluid level in the tanks.

Because of the gravitational balance between water in tube 62 and fluid in the tanks, the use of porous plug 61 is not essential in preventing cleaning solvent from entering tube 62. It is, however, an inexpensive precautionary element. This will prevent overflowing of fluid should tube 62 ever become filled with solvent.

Chamber 63 is pivoted about off-center support point 64. Fin-shaped members 65 serve a dual purpose. They act as a counterweight so that when chamber 63 is empty, the chamber tips to the left. Since support point 64 is to the left of the centroid of the bottom area projection of the chamber, the chamber will tip to the right when sufficiently filled with water. The surface area of the fins is such that the total bottom surface area moment to the left of pivot point 64 equals that to the right of point 64. This insures that scale build-up in the chamber bottom will not affect its balance.

When the water level in the chamber is sufficient to cause it to tilt to the right, switch 66 is activated, completing the circuit that supplies electrical power to heating element 67. Heating element 67 is used to evaporate the water in chamber 63. The modest amount of water dispensed in this manner as steam may be vented directly into the washroom with no deleterious effects. Heating element 67 requires only about 100 watts of operating power.

Disposal of water in the tanks can, of course, be accomplished by numerous other methods. In many installations, direct connections to the washroom's drain plumbing may be convenient. A chamber similar to 63 may be desirable in such installation in order to meet the anti-siphon requirements of the plumbing codes. The swivel, fin, and heater features are not required in this type of disposal systems.

Water is the major foreign material that is normally introduced into the cleaning system. Small amounts of soap, dirt, grease, lipstick, and other substances, however, may also be introduced via normal towel use. Eventually, the introduction of these substances will contaminate the cleaning fluids in the first tank 12. The isolated multiple tank design of the present invention, and the use of squeeze or wringer action between tanks, substantially retard contamination of successive tanks.

The use of a filtering and purifying system greatly extends the utility period of the cleaning solvent. FIG. 3 illustrates the basic elements of a suitable system. Motor 27 is used to operate pump 68 which may, for example, be of the simple diaphragm type. Reciprocating motion is imparted to the lever arm 69 of pump 68 via eccentric cam 70 which is driven by motor shaft 71. Contaminated cleaning solvent from the first tank 12 is pumped from a region below separator 58 near the bottom of the tank through tubing element 72, pump 68, and filter 73 successively. Filtered and purified solvent is returned to the last tank 15 through tubing element 74. Although any ordinary porous filter element will remove many types of suspended particulate matter, soap and other types of contamination require a more effective purifying process. Experiments have shown that filtering through an element containing both activated charcoal and a decolorizing clay is quite effective in removing residual contamination. Suitable decolorizing clays include Fuller's earth, chemically treated bentonites, magnesium silicate, and magnesium oxide.

Distillation is an alternative method of purifying the solvent. A continuous process using a heating power of approximately 50 watts has been found to be effective.

Figure 7:
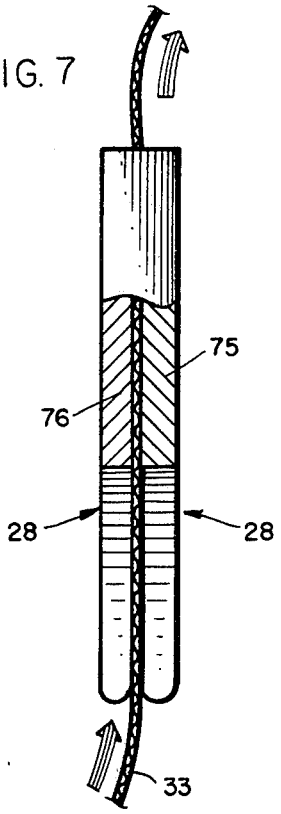
FIG. 7 is a fragmentary side view partly in section of certain details of the towel straightening and guiding device.
Figure 8:
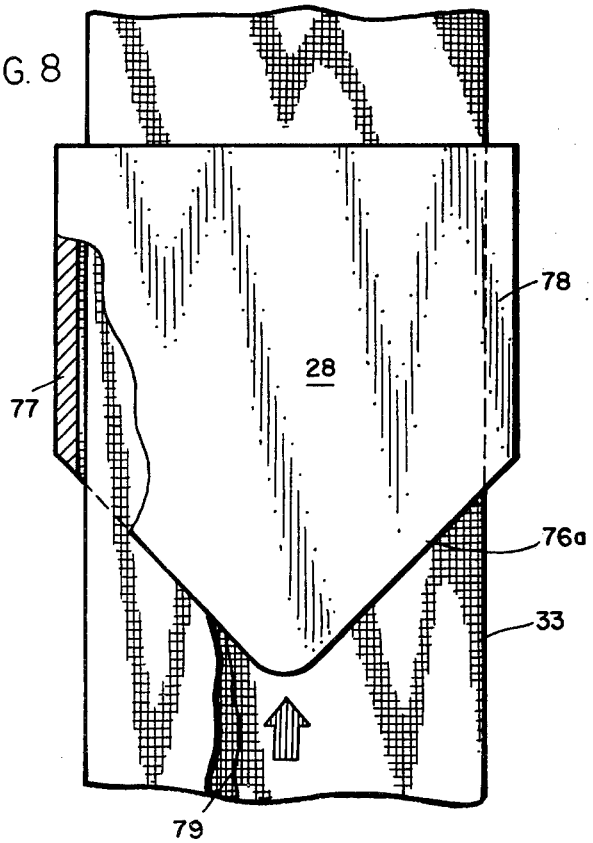
FIG. 8 is a front view partly broken away of certain details of the towel straightening and guiding device.

Proper operation of the apparatus requires a means for eliminating longitudinal folds or wrinkles in the toweling that may occur during use of the apparatus. Although there are many possible ways of satisfying this requirement, FIGS. 7 and 8 illustrate details of a novel and particularly simple means for centering and removing folds or wrinkles from the towel. Towel straightening and guiding device 28 makes use of the fact that towel member 33 has a relatively closely defined thickness. A suitable fabric used in this application was found to have a thickness of 0.010 inch. The towel is caused to pass between two rigid parallel spaced plates 75 and 76. The separation of the plates is accurately maintained by side spacers 77 and 78, and is constructed to be just slightly more than the towel thickness. Since a fold involves at least two layers of fabric, no fold can enter the space between the plates. Both plates are made with very smooth surfaces and with a wedge-shaped contour 76*a* at the towel entrance opening. The edges of the wedge-shaped opening are slightly rounded. Folds and wrinkles such as 79 are forced sidewards as the towel is drawn through the straightening device. Because spacers 77 and 78 constrain lateral displacement of the towel, device 32 also functions so as to center the towel.

While a preferred form of the invention has been described, many variations of the details are possible without departing from the scope and spirit of the claims.

What is claimed is:

1. Apparatus for dispensing rolled fabric toweling including a cabinet and a clean toweling storage compartment, means for allowing manual withdrawal of lengths of clean toweling from said clean toweling storage compartment and said cabinet, and electric motor driven means for retracting lengths of use toweling to within said cabinet, a slot located in the surface of said cabinet through which said toweling is caused to pass upon retraction of said lengths of use toweling to within said cabinet, the dimension of the opening of said slot in a direction transverse to the surface of toweling sections lying within said slot being no larger than 0.070 inches, and the external surfaces of said slot adjacent said opening being abruptly joined to the surfaces of said slot generally parallel to said towel sections lying within said slot.

2. The apparatus set forth in claim 1, and including electric switch means for sensing initiation of the manual withdrawal of clean toweling, time delay means actuated by said electric switch means, said time delay means being arranged to control the starting of said electric motor driven means.

3. The apparatus set forth in claim 1 and including electric switch means for sensing the condition when the length of toweling outside of said cabinet is at a minimum, time delay means actuated by said electric switch means, said time delay means being arranged to control the stopping of said electric motor driven means.

4. The apparatus set forth in claim 1 and including electric switch means for sensing the initiation of manual withdrawal of clean toweling, and means controlled by said electric switch means for starting said electric motor drive means.

5. The apparatus set forth in claim 1 and including a slot located in the surface of said cabinet through which said toweling is caused to pass upon retraction of said lengths of used toweling to within said cabinet, the dimension of the opening of said slot in a direction transverse to the surface of toweling sections lying within said slot being no larger than .070 inches, and the external surface of said slot adjacent said opening being abruptly joined to the surfaces of said slot generally parallel to said towel sections lying within said slot.

6. The apparatus set forth in claim 1 and including electrical switch means for sensing abnormal forces resisting the retraction of said lengths of used toweling, and said electrical switch means being used to disconnect electric power from said electric motor driven means.

7. Apparatus for dispensing rolled fabric toweling including a cabinet and a clean toweling storage compartment means for allowing manual withdrawal of lengths of clean toweling from said clean toweling storage compartment and said cabinet, and electric motor driven means for retracting lengths of used toweling to within said cabinet, towel straightening means consisting of two smooth surfaced plate members in spaced relation such that the separation of substantial portions of adjacent surface of said plate members is less than two times the thickness of the toweling, the leading edge of said plate members being smooth and being of a shape that extends in a trailing direction along both sides of a central point, the arrangement where portions of said toweling is caused to pass between said plate members.

* * * * *